US006409114B1

(12) United States Patent
Magnusson et al.

(10) Patent No.: US 6,409,114 B1
(45) Date of Patent: Jun. 25, 2002

(54) YARN FEEDING DEVICE

(75) Inventors: Patrik Jonas Magnusson, Boras; Alf Bengtsson, Fritsla, both of (SE)

(73) Assignee: IRO Patent AG, Baar (CH)

( * ) Notice: Subject to any disclaimer, the term of this patent is extended or adjusted under 35 U.S.C. 154(b) by 0 days.

(21) Appl. No.: 09/581,693

(22) PCT Filed: Dec. 17, 1998

(86) PCT No.: PCT/EP98/08298

§ 371 (c)(1),
(2), (4) Date: Oct. 2, 2000

(87) PCT Pub. No.: WO99/30998

PCT Pub. Date: Jun. 24, 1999

(30) Foreign Application Priority Data

Dec. 17, 1997 (DE) ..... 197 56 243

(51) Int. Cl.[7] ..... B65H 51/20

(52) U.S. Cl. ..... 242/364.7; 242/365.1; 242/365.4

(58) Field of Search ..... 242/364.7, 365.1, 242/365.3, 365.4

(56) References Cited

U.S. PATENT DOCUMENTS 3,759,455 A * 9/1973 Clemens ..... 242/364.7
3,776,480 A 12/1973 Lawson
3,844,504 A 10/1974 Lawson
4,226,379 A * 10/1980 Brouwer et al. ..... 242/364.7
4,715,411 A * 12/1987 Van Bogaert et al. ... 242/365.3 X
6,158,480 A * 12/2000 Pedrini ..... 139/452

FOREIGN PATENT DOCUMENTS

DE 23 15 392 11/1973

OTHER PUBLICATIONS

Operation and Maintenance Instructions IWF 9007, IWF 9107, IWF 9207 of IRO AB. Reference No. 8930–0812–01/9647; 1999; pp. 1–33, 35–39, 41–47, 49–53, 55–64.

* cited by examiner

*Primary Examiner*—Michael R. Mansen
*Assistant Examiner*—Minh-Chau Pham
(74) *Attorney, Agent, or Firm*—Flynn, Thiel, Boutell & Tanis, P.C.

(57) ABSTRACT

A yarn feeding device including a storage drum for a yarn supply and a sensor device located outside the storage drum in a sensor housing. The sensor device includes several movably mounted sensor arms, each of which extends from an axis with a sensor arm carrying a sensor base to the yarn supply on the storage drum where it can be moved out of a home position. The yarn feeding device further includes a spring system which impinges on the sensor arm, as well as a signal-generating device for detecting the position of the sensor arm. The sensor arms and their sensor arm parts are mounted on a common axis.

17 Claims, 3 Drawing Sheets

YARN FEEDING DEVICE

FIELD OF THE INVENTION

The invention relates to a yarn feeding device having a storage drum which stores yarn in windings thereon, a sensor including several movable feeler arms displaceable out of home positions by the yarn windings, a spring assembly which loads each feeler arm towards the home position, and a signal generating detecting device for detecting the position of the feeler arms.

BACKGROUND OF THE INVENTION

A yarn feeding device having such a sensor device is known from operation and maintenance manual IWF 9 007, IWF 9 107, IWF 9 207 of the company IRO AB, SE, reference number 07-8930-0812-01/9647, pages 10, 43, 44, 50, 51 and 53. Inside the sensor device, two feeler arms are arranged one above the other and such that their feeler feet detect the yarn store for the presence or absence of yarn at two locations in the advancing direction of the yarn windings on the storage drum. Each feeler arm is formed as a wire bracket with two legs. A bent feeler foot protrudes downwardly from the sensor housing. Each feeler arm has its own pivot axis where a sleeve can be clamped which carries an arm prolonging the feeler arm beyond the pivot axis to the side opposite the feeler foot. The end of this arm engages in the detecting device arranged within the sensor housing or at the housing of the yarn feeding device, and at the side of the pivot axis opposite to the feeler foot. Within the detecting device, an opto-electronic switch is provided which generates a signal when shadowed by the arm. A bending spring is anchored to the detecting device and extends in the direction towards the pivot axes of both feeler arms and actuates each arm such that the feeler foot is loaded in an elastic resilient fashion towards its home position, irrespective of the mounting position of the yarn feeding device. The sensor device includes a plurality of components, needs much mounting space in the direction of the axis of the storage drum and in the lateral direction, requires particular care and skill for adjustments, and shows an occasional unstable response behavior in delicate operation conditions.

It is an object of the invention to create a yarn feeding device as mentioned above which is characterized by a compact sensor device including few single parts and having an accurate but insensitive response behavior.

This object is achieved by supporting the plurality of feeler arms with their feeler arm portions on a common axis. The sensor device can therefore be made compact and has only a few components. All of the feeler arms can be placed at essentially the same radial distance from the storage drum. The feeler feet may have essentially the same effective lengths. By a compact arrangement of the feeler arms with essentially equal movement relationships among themselves at the common axis and with the feeler feet of essentially the same length, an accurate but insensitive response behavior of the sensor device can be achieved. Further, the common axis for all feeler arms saves mounting space within the sensor housing.

At least two, preferably even three, feeler arms can be supported on the common axis such that several functions can be carried out by one compact sensor device.

The axis is arranged within the sensor housing where it may be placed at an optimum location. Expediently, said axis is secured without the possibility of rotation while the feeler arms can be pivoted in relation to said axis. However, it is possible to support said axis in a rotatable fashion.

The axis extends essentially laterally to the longitudinal direction of the storage drum axis, the feeler arms are arranged so as to be essentially parallel to the storage drum axis, and the feeler feet are located at different distances from the axis. A shim sensor device is the result which advantageously is received within the bracket of the yarn feeding device. Expediently, each feeler arm portion is only as long as the distance of its feeler foot from said axis. For this reason, said feeler feet can be placed neatly within an axial array.

The axis is oriented essentially parallel to the direction of the axis of the storage drum, while said feeler arms lie laterally with respect to the axis of said storage drum. For this reason, feeler arm portions of equal lengths and equal lever arms for the feeler feet can be realized. Moreover, said feeler feet can be arranged exactly within an axial array along said storage drum.

The spring assembly includes a spring element and a switch-over device which allows adjustment of the spring force if the feeler arm has reached a predetermined stroke position out of the home position. The generation of detrimental vibrations influencing the response behavior is prevented in a structurally simple way. The spring element not only has the task of generating the load for the feeler arm in a direction towards its home position independent from the mounting position of the yarn feeding device, but additionally and without significant structural efforts also dampens the generation of oscillating swing movements of the feeler arm in critical operation conditions, occasionally already in motion. This is achieved by making the spring harder in dependence from its stroke and for a motion range of the feeler arm into which the feeler arm may move due to certain operation dynamics while not detecting the presence or absence of the yarn store. The compulsory damping suppresses an undesirable oscillation effect without influencing the operation of the feeler arm during detection of the presence or absence of the yarn. Vice versa said dampening effect improves the correct operation of the feeler arm within its intended detecting operational range.

The spring suspension of the feeler arm and the above-mentioned damping effect are achieved in a structurally simple way, in that the spring element is a freely ending bent spring which actuates the feeler arm portion, and at the side of the spring element opposite the feeler arm a damping boss is provided and constitutes the switch-over device.

Since the detecting device and the spring assembly are integrated into the sensor housing at the same side of the axis like the feeler arm portions carrying the feeler feet, considerable mounting space is saved in the direction of the axis of the storage drum. Moreover, the number of single components of the sensor device is reduced. Mounting space also is saved lateral to the axis of the storage drum since the respective, co-acting parts can be arranged close to one another. This is of advantage for a sensor device having several feeler arms and correspondingly many accessory parts. Thanks to the compact arrangement, detrimental vibrations are prevented so that a stable but nevertheless sensitive response behavior is achieved.

Since the detecting device faces the spring assembly via the feeler arms operating in between, space can be saved.

The feeler arms extend beyond said axis feeler arm portions which cooperate with the detecting device and/or the spring assembly. In this case, more mounting space might be needed in the direction of the axis of the storage drum. However, the detecting device then is protected against contamination and lint.

The feeler arm portions are of different lengths to achieve at least substantially similar lever relationships and motion relationships when detecting the position of the feeler arms despite the different distances of the feeler feet from the common axis.

The feeler arm portions are formed as ballast masses or are equipped with ballast masses. A weight balance is achieved by said masses. Said weight balance protects the yarn against undesirable strong mechanical loads.

The detecting device is arranged outside the sensor housing on a printed circuit board. The feeler arm portions of the feeler arms extend beyond the common axis and reach towards the detecting device and are protected against contamination while co-acting with the detecting device. In addition, the prolongated feeler arm portions result in a weight balance which is more wear resistant and, for this reason, heavier feeler feet can be used.

BRIEF DESCRIPTION OF THE DRAWINGS

Embodiments of the invention will be described with reference to the drawings, in which.

DETAILED DESCRIPTION

Figure 1:
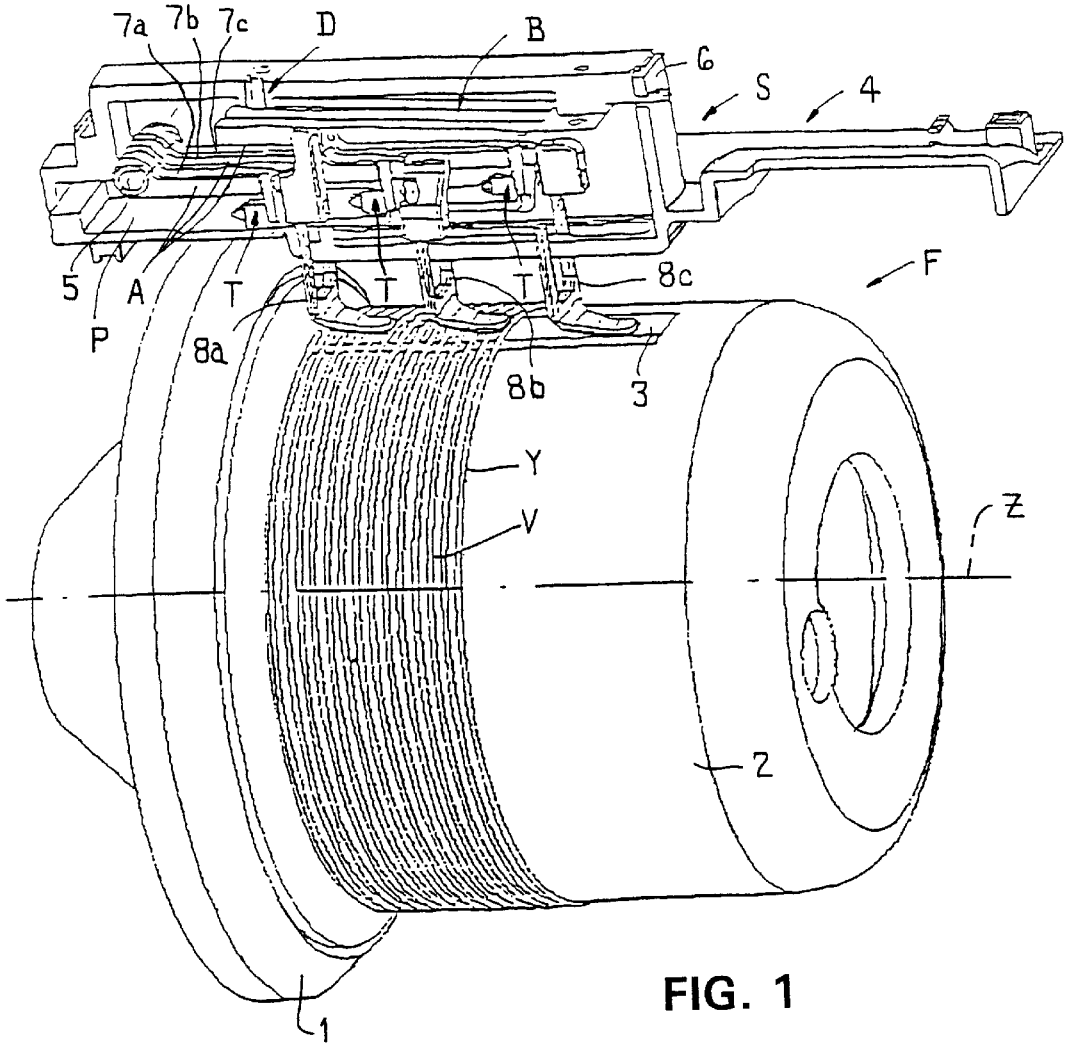
FIG. 1 is a schematic and perspective partial sectional view of main components of a yarn feeding device.

FIG. 1 shows a fragmentarily illustrated yarn feeding device F, e.g. a weft yarn feeding device for a weaving machine, a winding element 1 of a storage drum 2, to which a sensor device S is associated which is connected to the housing (not shown) or a housing bracket 4. In this embodiment, three feeler arms A are provided extending essentially parallel to one another in the direction of the axis Z of storage drum 2 for monitoring a yarn store V of windings of a yarn Y on said storage drum 2. Said yarn store V is formed by a relative rotational movement between the winding element 1 and the storage drum 2 (in the shown embodiment a stationary storage drum 2) with an axial side which is automatically maintained to avoid the situation wherein the storage drum 2 runs empty despite continuous or intermittent yarn consumption. Yarn store V bridges a longitudinally extending depression 3 in storage drum 2. Feeler feet 8*a* to 8*c* are aligned with said impression 3. Each feeler foot is held by spring force in a home position such that it engages into depression 3, preferably without direct ground contact. From said home position shown in FIG. 1, each feeler foot can be displaced upwardly by the yarn store V.

Feeler foot 8*a* at the left side in FIG. 1 may belong to a yarn breakage detector responding as soon as the first windings of the yarn store V are not formed properly. Feeler foot 8*b* may belong to a minimum sensor monitoring the minimum tolerable axial size of yarn store V. Said minimum sensor activates the drive of winding element 1 in case of absence of the yarn store V in this area in order to replenish the yarn store V. Feeler foot 8*c* may belong to a so-called maximum sensor which, when displaced from the home position shown in FIG. 1, switches off or decelerates the drive of winding element 1 since the tolerable maximum size of the yarn store V then is reached.

Each feeler arm A consists of a feeler arm portion 7*a* to 7*c* and the already mentioned feeler foot 8*a* to 8*c*. Said components can be manufactured separately and can be connected to one another in a detachable fashion. All three feeler arms A are pivotably supported on a common axis 5 in a sensor housing 6. Axis 5 extends essentially lateral to the direction of the axis of storage drum 2. Alternatively, it would be possible to arrange axis 5 parallel to the axis of storage body 2 and to align the feeler arms A lateral to the axis of storage drum 2. Expediently, axis 5 is secured within sensor housing 6. Feeler arms A are arranged around axis 5 with inserted or integrated bearing sleeves which also can be used to determine the relative distances between the feeler arms.

A spring assembly B is provided within sensor housing 6. A switch-over device D is associated with said spring assembly B. Sensor housing 6 is integrated into bracket 4 of the housing of said yarn feeding device. A detecting device T is associated with each feeler arm A. Detecting device T generates at least one signal for an associated monitoring or control device depending on the initial pivot position of its feeler arm. Said detecting device T can be an opto-electronic, electric, electronic or electromagnetic detector detecting the pivot position of the associated feeler arm A in a contactless fashion, or maybe an electric switch actuated by its feeler arm A. Spring assembly B and said detecting devices T are arranged in FIGS. 1 to 3 at the same side of the common axis 5 as the feeler arm portions 7*a* to 7*c* carrying the feeler feet 8*a* to 8*c*. The detecting devices T in this case are situated below feeler arm portions 7*a* to 7*c*, while spring assembly B is situated above.

Figure 2:
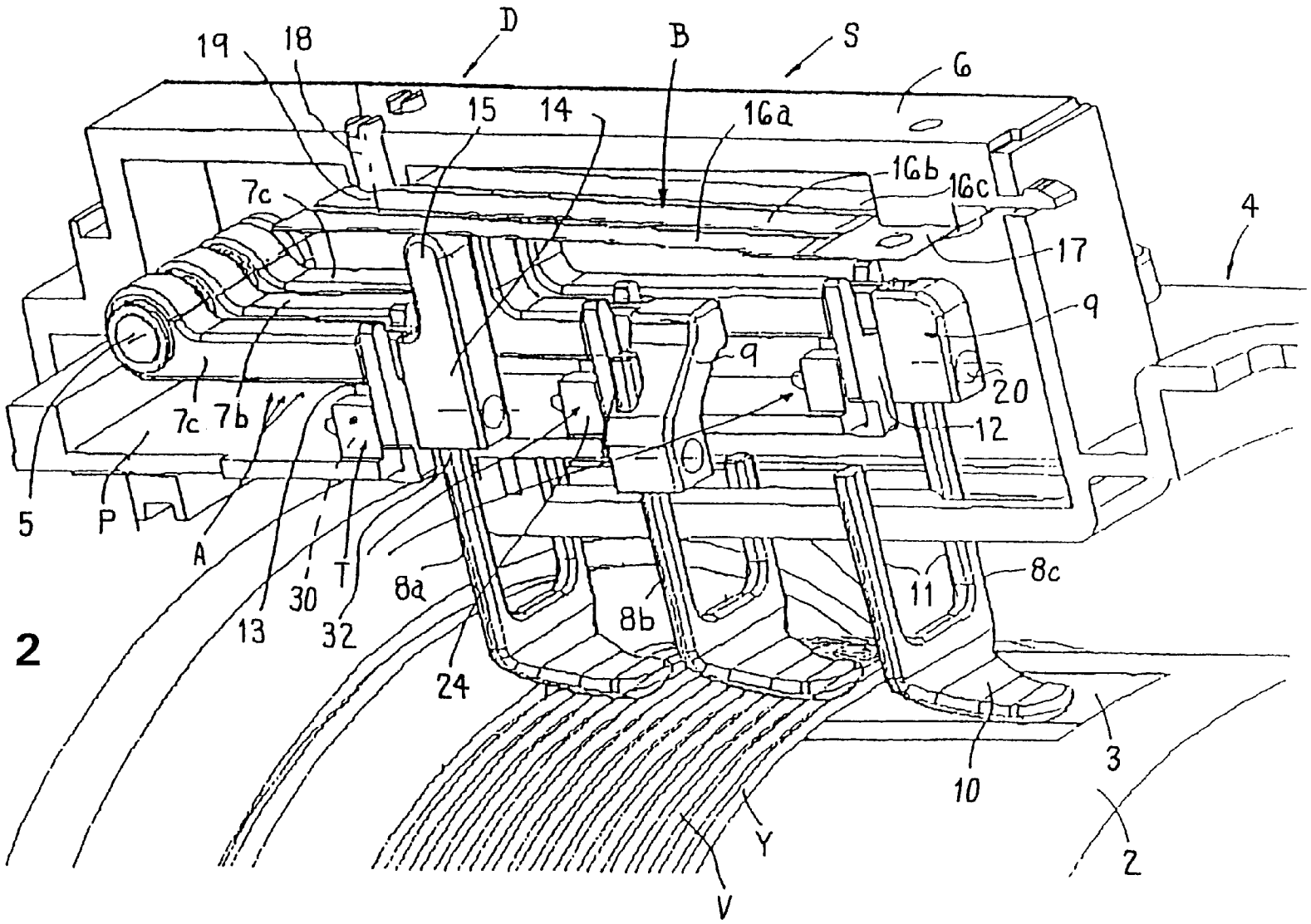
FIG. 2 is a perspective partial sectional view similar to the one of FIG. 1 in an enlarged scale.

In the enlarged illustration of the sensor device S in FIG. 2, it can be seen that each feeler arm portion 7*a* to 7*c* is a molded part, e.g. of plastic material (injection molded part), into which a shift socket 9 for the respective feeler foot 8*a* to 8*c*, a stop 14 for the spring assembly B, an actuator 13 for the detecting device T and the bearing sleeve receiving axis 5 are structurally integrated.

It is to be noted that the sensor drive S may have more or less feeler arms A than the three shown here.

In the shown embodiment, feeler feet 8*a* to 8*c* are identical, although they might in general be different from one another. Each feeler foot 8*a* to 8*c* may be e.g. a metal molded part, e.g. a pressure casted part, and has a foot tip defining a continuous lower surface 10 and two essentially parallel and spaced apart legs 11. One of said legs 11 can be inserted in the respective shift socket 9 of a feeler arm portion 7*a* to 7*c* and may be secured in place by a securing element 20. The respective other leg 11 ends freely or is shortened to the necessary length. The width of each feeler foot 8*a* to 8*c* is larger than the distance between adjacent feeler arm portions 7*a* to 7*c*, which is made possible by a lateral offset of the position of shift socket 9 in feeler arm portion 7*b*. Optionally, each shift socket 9 can be adjusted in the longitudinal direction on its feeler arm potion 7*a* to 7*c* allowing adjustment of the relative positions of feeler feet 8*a* to 8*c*.

A stationary guiding fork 12 is associated with each feeler arm portion 7*a* to 7*c*. Feeler arm portion 7*a* to 7*c* is guided between the fork tines of said guiding fork 12 or is at least hindered against sideward movements. The stops 14 on feeler arm portions 7*a* to 7*c* are situated equal distances from axis 5 and have upper rounded surfaces 15 each contacting a spring element 16*a* to 16*c* of spring assembly B to take up the pressure of said spring elements and to hold each feeler foot 8*a* to 8*c* in its home position (shown for the right feeler foot 8*c* in FIG. 2) in an elastic resilient fashion until said feeler foot is displaced out of its home position by the lifting force of the yarn Y. Spring elements 16*a* to 16*c* shown in FIG. 2 belong expediently to a single spring element which is anchored at 17 in sensor housing 6. Spring elements 16*a* to 16*c* are bending springs, preferably leaf springs, which are freely ending. The switch-over device D includes an individually adjustable damping boss 18 for each spring element 16*a* to 16*c* , e.g. a set screw, which is accessible from the outer side of sensor housing 6 and is aligned towards a contact zone 19 on the associated spring element 16*a* to 16*c*. Through the normal operation stroke of feeler feet 8*a* to 8*c* , spring elements 16*a* to 16*c* do not contact their damping bosses 18. Only if, due to excessive dynamics, an excessive stroke of feeler arm A should occur, its spring element 16*a* to 16*c* will abut at its damping boss 18. Since the contact zone 19 is situated at the side of surface 15 opposite to the anchoring location 17, said spring element 16*a* to 16*c* then will become significantly harder such that the swinging motion of the feeler arm A immediately is damped and such that feeler arm A is forced back into its normal operation range.

Said detecting devices T are provided in holders 24, e.g. on a board P including passing apertures 32 for the legs 11 of feeler feet 8*a* to 8*c*. Said board P may carry printed conductors and occasionally other electric or electronic components.

Figure 3:
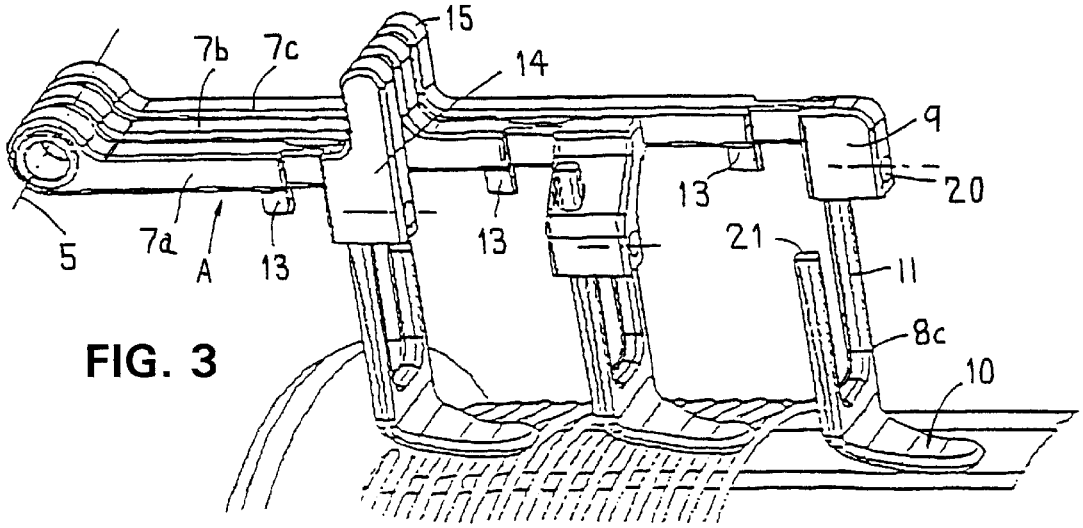
FIG. 3 is an enlarged perspective view of components of FIGS. 1 and 2 separated from the general structure.

FIG. 3 shows a cut-off or free end 21 of one leg 11 of feeler foot 8*c*. Said cut-off end 21 could be used as a limiter for the upward stroke of the associated feeler arm A when contacting the lower side of plate P. In FIG. 3, each actuator 13 is a flag formed at the lower side of feeler arm portion 7*a* to 7*c* serving according to FIG. 4 to define the home position of feeler arm portion 7*a* to 7*c* in cooperation with a stationary stop (FIG. 1).

Figure 4:
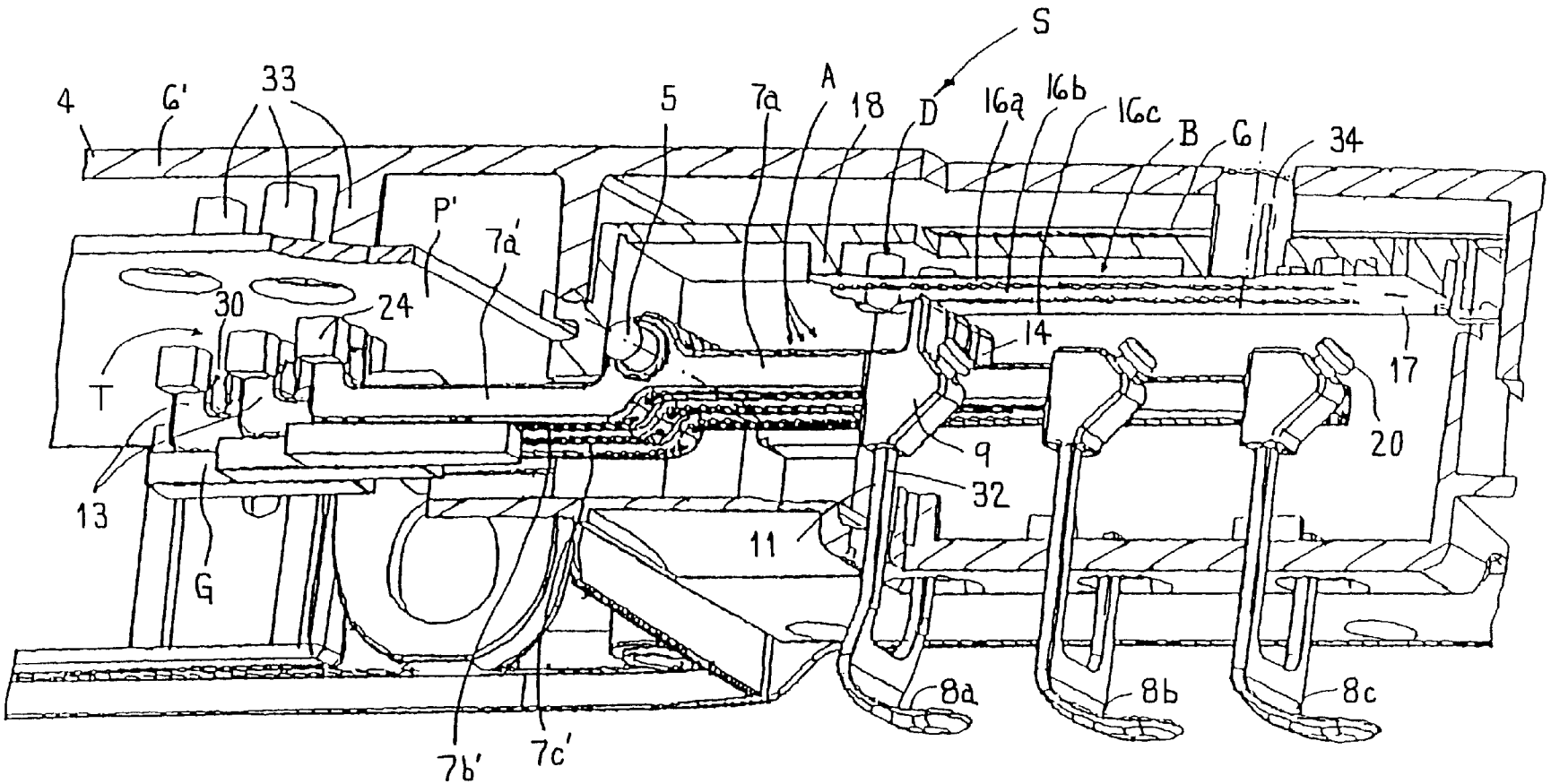
FIG. 4 is a partial sectional view of a further embodiment.

According to FIG. 4, said feeler arms A are lengthened by feeler arm portions 7*a′* to 7*c′* beyond the common axis 5 in sensor housing 6. The respective detecting device T is arranged at the side of the axis 5 opposite to feeler feet 8*a* to 8*c* , e.g. within a yarn feeding device housing section 6' of bracket 4 receiving a board P' of the yarn feeding device F. Holders 24 or components of the detecting device, respectively, may be arranged at said board P'. Stops 30 for the flags at feeler arm portions 7*a′* to 7*c′* are formed by protrusions 33 penetrating board P' and being expediently formed unitarily with said yarn feeding device housing section 6' of bracket 4. Feeler arm portions 7*a′* to 7*c′* may be formed as ballast masses G or may be (as shown) equipped with ballast masses G, respectively. In FIG. 4, switch-over device D has stationarily installed damping bosses 18.

The preload of the spring assembly D anchored at 17 is adjustable centrally by means of an adjustment screw 34 which is provided within sensor housing 6 and is accessible from the outer side through bracket 4. Sensor housing 6 is received within bracket 4. In FIG. 4, the same reference numbers are used for components equivalent to components already described in connection with the preceding FIGS.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A yarn feeding device having a storage drum for storing a yarn store including adjacently laid down windings of a yarn, a sensor device provided within a sensor housing arranged outside of said storage drum, said sensor device comprising a plurality of movably supported feeler arms each of which extends by a feeler arm portion carrying a feeler foot into the movement path of the windings along said storage drum and each of which is displaced by said windings out of a home position, a spring assembly loading each feeler arm in a direction towards its home position, and a signal generating detecting device for detecting an initial position of each said feeler arm, said plurality of feeler arms being supported with their feeler arm portions on a common axis.

2. Yarn feeding device as in claim 1, wherein said plurality of feeler arms includes at least three feeler arms supported on said common axis.

3. Yarn feeding device as in claim 1, wherein said common axis is arranged within said sensor housing.

4. Yarn feeding device as in claim 1 wherein said common axis extends essentially laterally relative to the longitudinal direction of an axis of said storage drum, said feeler arms are aligned essentially parallel to the axis of said storage drum, and said feeler feet provided at said feeler arm portions being located different distances from said common axis.

5. Yarn feeding device as in claim 1, wherein said spring assembly includes a spring element corresponding to each said feeler arm and a spring stroke depending switch-over device which allows adjustment of the spring force of said spring element so as to increase the spring force or provide a harder spring characteristic if the corresponding feeler arm has reached a predetermined stroke position out of said home position.

6. Yarn feeding device as in claim 5, wherein each said spring element is a freely ending bending spring actuating the corresponding feeler arm portion at a stop arranged thereon in a pivoting direction about said common axis, and at a side of each said spring element opposite said feeler arm a damping boss is aligned with the respective spring element, said damping boss constituting said switch-over device, an engagement zone of said damping boss with the respective spring element being offset in a longitudinal direction of said spring element in relation to an engaging point of said stop of said feeler arm portion and said spring element.

7. Yarn feeding device as in claim 6 wherein each said spring element comprises a leaf spring.

8. Yarn feeding device as in claim 1, wherein said spring assembly and said detecting device are arranged at the same side of said common axis as said feeler arm portions carrying said feeler feet.

9. Yarn feeding device as in claim 8, wherein said feeler arm portions directly co-act with the detecting device, said detecting device and said spring assembly both being arranged within said sensor housing in the moving paths of the respective feeler arms but at opposite sides thereof.

10. Yarn feeding device as in claim 1, wherein each said feeler arm is extended beyond said common axis in a direction away from the respective feeler foot by the respective feeler arm portion, the feeler arm portions reaching the detecting device, said detecting device being situated at a side of said common axis opposite to said feeler feet, and said spring assembly being situated at the same side of said common axis as said feeler feet.

11. Yarn feeding device as in claim 10, wherein said feeler arm portions are of different lengths.

12. Yarn feeding device as in claim 10, wherein said feeler arm portions are formed as ballast masses or are equipped with ballast masses.

13. Yarn feeding device as in claim 10, wherein adjacent to said common axis provided within said sensor housing, a control board of a drive control of the yarn feeding device is provided at an outside of said sensor housing, said detecting device being situated on said control board, and said feeler arm portions extend out of said sensor housing to the detecting device arranged on said board.

14. Yarn feeding device as in claim 1 wherein said detecting device generates a signal received by a control device of the yarn feeding device based upon detection of the initial position of each said feeler arm.

15. Yarn feeding device as in claim 14 wherein said plurality of feeler arms includes three said feeler arms which are pivotably supported about said common axis within said sensor housing and oriented transversely relative to an axis of said storage drum, said feeler arms being disposed in parallel with said storage drum axis, said feeler feet each being disposed at different distances from said common axis.

16. Yarn feeding device as in claim 15 wherein said spring assembly is disposed within said sensor housing, said spring assembly including three spring elements disposed to respectively bias said three feeler arms towards the respective home positions in opposition to a lifting force of the yarn disposed on said storage drum.

17. Yarn feeding device as in claim 16 wherein said spring elements comprise leaf springs having first ends which are anchored within said sensor housing and second ends which engage the respective feeler arms to bias same in the respective home positions, said spring assembly including a device which permits adjustment of the spring force of the respective leaf springs.

* * * * *